US008267181B2

(12) United States Patent
Peixoto

(10) Patent No.: US 8,267,181 B2
(45) Date of Patent: Sep. 18, 2012

(54) OPEN-HOLE MUDCAKE CLEANUP

(75) Inventor: Luis Felipe Peixoto, Balikpapan (ID)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 12/563,773

(22) Filed: Sep. 21, 2009

(65) Prior Publication Data

US 2011/0067877 A1 Mar. 24, 2011

(51) Int. Cl.
*E21B 34/06* (2006.01)
*E21B 34/12* (2006.01)

(52) U.S. Cl. ..... 166/373; 166/222; 166/223; 166/332.1; 175/424

(58) Field of Classification Search ..... 166/278, 166/373, 222, 223, 332.1; 175/424
See application file for complete search history.

(56) References Cited

U.S. PATENT DOCUMENTS

| | | | | |
|---|---|---|---|---|
| 4,560,005 | A | 12/1985 | Helderle et al. | |
| 5,195,585 | A | 3/1993 | Clemens et al. | |
| 5,337,819 | A | 8/1994 | Tailby | |
| 6,170,577 | B1 | 1/2001 | Noles, Jr. et al. | |
| 6,607,607 | B2 | 8/2003 | Walker et al. | |
| 6,923,871 | B2 | 8/2005 | Walker et al. | |
| 6,982,008 | B2 | 1/2006 | Walker et al. | |
| 7,377,283 | B2 | 5/2008 | Walker et al. | |
| 2006/0231253 | A1 * | 10/2006 | Vilela et al. | 166/278 |

* cited by examiner

*Primary Examiner* — Kenneth L Thompson
*Assistant Examiner* — Cathleen Hutchins
(74) *Attorney, Agent, or Firm* — David G. Matthews; Robb D. Edmonds; Rodney Warfford

(57) ABSTRACT

Apparatus and methods for performing downhole operations. The apparatus can include a sealing mechanism having an inner bore formed therethrough; a check valve adjacent the sealing mechanism; a circulation device adjacent the check valve; and a rotatable nozzle adjacent the circulation device. The circulation device can include a first tubular member having a radial hole formed therethrough, and a second tubular member disposed about at least a portion of the first tubular member. The second tubular member can also have a radial hole formed therethrough, and the second tubular member can be adapted to longitudinally move about the first tubular member from a first position to a second position.

20 Claims, 3 Drawing Sheets

OPEN-HOLE MUDCAKE CLEANUP

BACKGROUND

In open-hole wellbores there is usually an impermeable mudcake layer deposited on the wellbore face that blocks the flow of fluids. A typical objective of open-hole completion operations is the removal of the impermeable mudcake from the wall of the wellbore, which allows for increased hydrocarbon production from a target reservoir to the surface. One conventional way to remove the mudcake from the wall of the wellbore is reducing the pressure within the wellbore relative to the surrounding reservoir. This reduction in pressure or "under balance" can cause the mudcake to "lift off" from the wellbore face. This procedure is problematic, however, because the "lift off" is often uneven allowing portions or sections of a wellbore to retain a layer of mudcake reducing the productivity of the wellbore.

Another conventional way to remove the mudcake is to apply a breaker treatment, such as an acid, to the mudcake as a running tool is recovered from the wellbore. The breaker treatment is run through the running tool and exits the running tool through an open-ended portion of the running tool. This method is problematic, however, because the flow of the breaker treatment is uneven as the breaker treatment tends to migrate to a portion of the wellbore where mudcake removal first occurs leaving other portions of the wellbore untreated.

SUMMARY

Apparatus and methods for performing downhole operations are provided. In at least one specific embodiment, the apparatus includes a sealing mechanism having an inner bore formed therethrough; a check valve adjacent the sealing mechanism; a circulation device adjacent the check valve; and a rotatable nozzle adjacent the circulation device. The circulation device can include a first tubular member having a radial hole formed therethrough, and a second tubular member disposed about at least a portion of the first tubular member. The second tubular member can have a radial hole formed therethrough, and the second tubular member can be adapted to longitudinally move about the first tubular member from a first position to a second position.

A system for performing a downhole operation is also provided. In at least one specific embodiment, the system includes the apparatus disposed at least partially within a completion assembly. The completion assembly, comprising: a first completion; a second completion; and a connection device disposed therebetween; wherein the connection device comprises a collet configured to longitudinally move the second tubular member of the apparatus.

In at least one specific embodiment, the method comprises: conveying a system into a wellbore, the system comprising the apparatus at least partially disposed within the completion assembly; flowing fluid from within the apparatus through the circulation device into the wellbore with the circulation device in a first configuration; locating the completion assembly within the wellbore adjacent a hydrocarbon bearing zone; performing a downhole operation; placing the circulation device in a second configuration; and flowing a treatment fluid through the rotatable nozzle, wherein the rotatable nozzle disperses the treatment fluid evenly about the wellbore.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Although many uses can be envisaged, the apparatus or running tool provided herein can be particularly useful for running a completion into a wellbore and to evenly, efficiently treat mudcake on a wall of a wellbore. For simplicity and ease of description, however, the apparatus will be further described with reference to such mudcake treatment.

Figure 1:
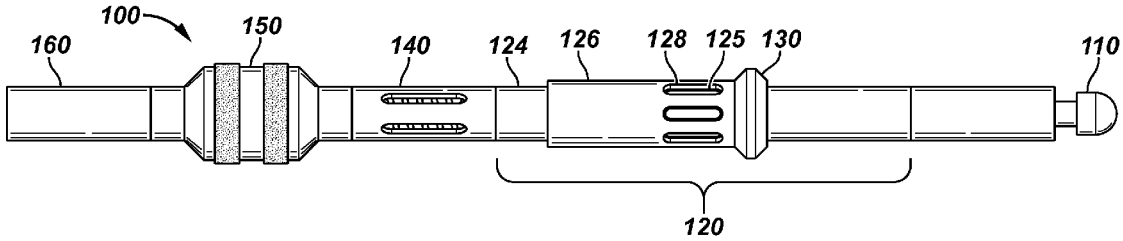
FIG. 1 depicts a cross sectional view of an illustrative embodiment of an apparatus, according to one or more embodiments described.

FIG. 1 depicts a cross sectional view of an illustrative embodiment of an apparatus, according to one or more embodiments. The apparatus can be a running tool 100 that can include a rotatable nozzle 110 connected to a circulation device 120. The circulation device 120 can selectively allow fluid to flow into and out of the running tool 100. The circulation device 120 can be adjacent a check valve 140. The check valve 140 can allow one-way fluid flow into the running tool 100.

The rotatable nozzle 110 can rotate from about 90 degrees to about 360 degrees. Fluid can flow through the rotatable nozzle 110, and the rotatable nozzle 110 can impart a pressure drop to the fluid exiting therefrom. This pressure drop can rotate the rotatable nozzle 110. As the rotatable nozzle 110 rotates, the fluid exiting therefrom can be evenly distributed about a wellbore. Any rotatable nozzle 110 can be used. For example, the rotatable nozzle 110 can be a "Jet Blaster" tool that is available from Schlumberger Technology Corporation of Houston, Tex., such as a jet blaster tool with a one inch or larger nozzle head. Details of illustrative blaster tools can be found in U.S. Pat. Nos. 6,397,864, 6,062,311, and 6,032,741, for example.

The circulation device 120 can include a first tubular member 124. The first tubular member 124 can connect the circulation device 120 to the rotatable nozzle 110 and the check valve 140. The first tubular member 124 can have a radial hole 125 formed therethrough. The "radial" direction can be the direction perpendicular to the central axis of the wellbore. The radial hole 125 can allow fluid to flow into and out of the first tubular member 124.

A second tubular member 126 can be disposed about at least a portion of the first tubular member 124. The second tubular member 126 can selectively block fluid flow through the radial hole 125. The second tubular member 126 can selectively "longitudinally" move about the first tubular member 124. The longitudinal direction can be the direction parallel to the central axis of the wellbore. A radial hole 128 can be formed through the second tubular member 126. When the second tubular member 126 is in a first position, the radial hole 128 can be aligned with the radial hole 125 to allow fluid flow therethrough. When the radial holes 125, 128 are aligned, the circulation device 120 can be said to be in an "open" or first configuration. When the second tubular member 126 is longitudinally moved from the first position to a second position, the radial holes 125, 128 can be aligned with solid portions of the tubular members 124, 126 respectively. Upon alignment of the radial holes 125, 128 with solid portions of the tubular members 124, 126, the circulation device 120 can be said to be in a "closed" or second configuration.

One or more stoppers 130 can be disposed about at least a portion of the first tubular member 124. The stopper 130 can be a ring welded or otherwise secured to the first tubular member 124. In one or more embodiments, the stopper 130 can be a collapsible sub, made of several fingers that can collapse once the sleeve 126 closes. The stopper 130 can be used to control the travel of the second tubular member 126 about the first tubular member 124. For example, the stopper 130 can be configured to ensure that the second tubular member 126 does not cover or engage the rotatable nozzle 110.

The check valve 140 can be adjacent or connected to the circulation device 120 and a seal member 150. The check valve 140 can be a ball and seat valve, a flapper check valve, or other valve capable of allowing fluid flow in a first direction and blocking fluid flow in a second direction. The check valve 140 can allow fluid from the wellbore or exterior of the running tool 100 to flow into the running tool 100. As such, fluid can be returned from the wellbore to the surface via check valve 140. For example, the check valve 140 can allow for return of a liquid portion of a gravel slurry to the surface.

The seal member 150 can be located adjacent the check valve 140. The seal member 150 can be secured or coupled to the check valve 140 at a "lower" or second end thereof. The seal member 150 can be connected at an "upper" or first end to a tubing string or other conveyance device 160. The seal member 150 can be made of two or more bonded seals. The bonded seals can be or include a rubber, elastomer, blends thereof, or other compliable material. A suitable sealing material nitrile rubber. The seal member 150 can form a seal within a completion system and can isolate a "lower" or first portion of the completion system from an "upper" or second portion of the completion system, as discussed in more detail below.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Figure 2:
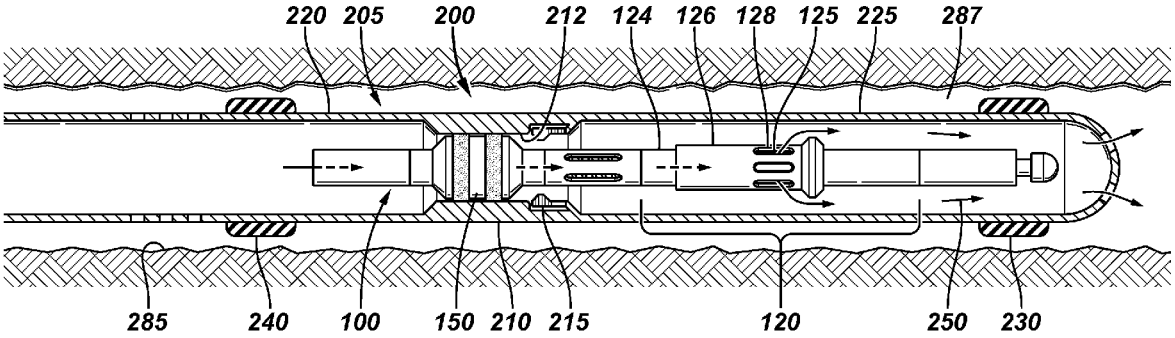
FIG. 2 depicts a cross sectional view of an illustrative completion system, according to one or more embodiments described.

FIG. 2 depicts a cross sectional view of a completion system 200, according to one or more embodiments. The completion system 200 can include the running tool 100 and one or more completion assemblies 205. The running tool 100 can be used to run the completion assembly 205 into a wellbore 285. The wellbore 285 can be an open hole or cased wellbore.

The completion assembly 205 can include one or more completions (two are shown 220, 225). The completions 220, 225 can include sand screen completions, such as those described in U.S. Pat. No. 6,725,929; inflow control device completions, such as those described in U.S. Pat. No. 6,857,475; or other completions for performing downhole operations.

The completions 220, 225 can be secured or couple to each other by one or more connection devices 210. The connection device 210 can be or include one or more polished bore receptacles 212 and one or more collets 215. The polished bore receptacle 212 can be configured to form a seal with the seal member 150, which can isolate the inner diameters of the completions 220, 225 from one another. The collet 215 can be used to close the circulation device 120. For example, when the running tool 100 is moved up towards the surface by less than 1 foot, about 1 foot, about 2 feet, about 3 feet, about 4 feet, about 5 feet, or more than 5 feet, the collet 215 can engage the second tubular member 126 and move the second tubular member 126 to the second position. For example, the collet 215 can engage one or more fingers disposed about the second tubular member 126.

The completions 220, 225 can have one or more packers 230, 240 disposed thereabout. The packers 230, 240 can be used to isolate different portions of the wellbore from one another and/or to isolate two or more completions 220, 225 from one another. For example, the completions 220, 225 can be located adjacent a hydrocarbon producing zone and the packers 230, 240 can isolate the hydrocarbon producing zone from other portions of the wellbore. The packers 230, 240 can be or include compression or cup packers, inflatable packers, "control line bypass" packers, polished bore retrievable packers, other common downhole packers, or combinations thereof.

As the completion assembly 205 is run into the wellbore 285, the circulation device 120 can be in the first configuration. Accordingly, as the completion assembly 205 is run into the wellbore 285 fluid can flow from the surface to an annulus 287, which is formed between the completion assembly 205 and a wall of the wellbore 285, via flow path 250. Flow path 250 can allow fluid to flow from within the running tool 100 to the completion assembly 205. The fluid can flow from the completion assembly 205 into the annulus 287.

Figure 3:
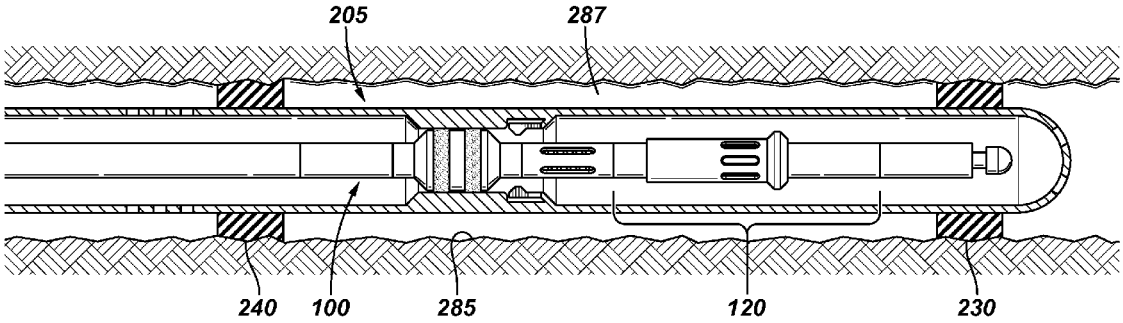
FIG. 3 depicts a cross sectional view of the completion system of FIG. 2 after location within a wellbore, according to one or more embodiments described.

Once the completion assembly 205 is properly located within the wellbore 285, the packers 230, 240 can be set, as depicted in FIG. 3. As the packers 230, 240 are set; the circulation device 120 can remain in the first configuration. After the packers 230, 240 are set in the wellbore 285, a downhole operation can be performed, such as a gravel pack.

Figure 4:
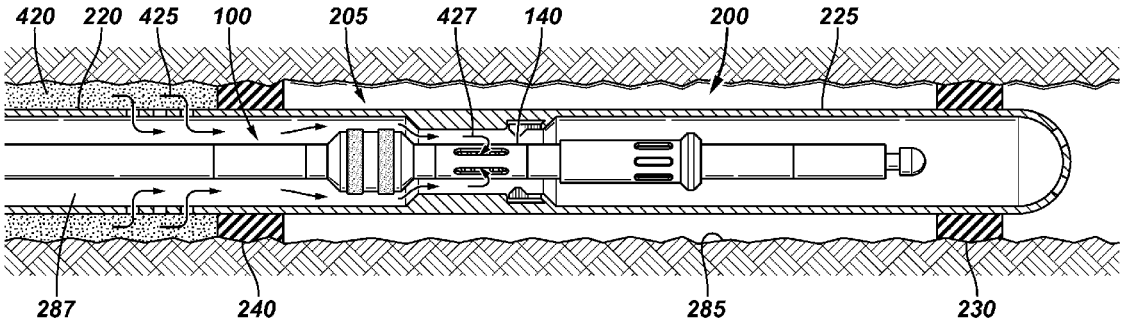
FIG. 4 depicts a cross sectional view of the completion system of FIG. 2 with the apparatus of FIG. 1 positioned to perform a gravel pack operation, according to one or more embodiments described.

FIG. 4 depicts a cross sectional view of the completion system 200 with the running tool 100 positioned to perform a gravel pack operation, according to one or more embodiments. Upon locating and securing the completion assembly 205 within the wellbore 285, a gravel slurry 420 can be pumped into the annulus 287. The gravel slurry can pack about the exterior of the completion assembly 205. A gravel pack or other downhole operation can be selectively performed about both of the completions 220, 225 or one of the completions 220, 225. For example, the gravel slurry 420 can be pumped into the annulus 287 about the completion 220. The gravel slurry 420 can include a particulate and a carrier fluid. The carrier fluid can migrate into the completion assembly 205 along flow path 425, which dehydrates the gravel slurry. For example, the carrier fluid can migrate from the annulus 287 into the completion assembly 205 through one or more screens (not shown) disposed about the completion assembly 205. After the carrier fluid migrates into the completion assembly 205, the carrier fluid can flow into the running tool 100 via flow path 427. For example, the fluid can flow into the running tool 100 via the check valve 140. After the gravel pack operation and/or other downhole operation is complete the running tool 100 can be moved towards the surface.

Figure 5:
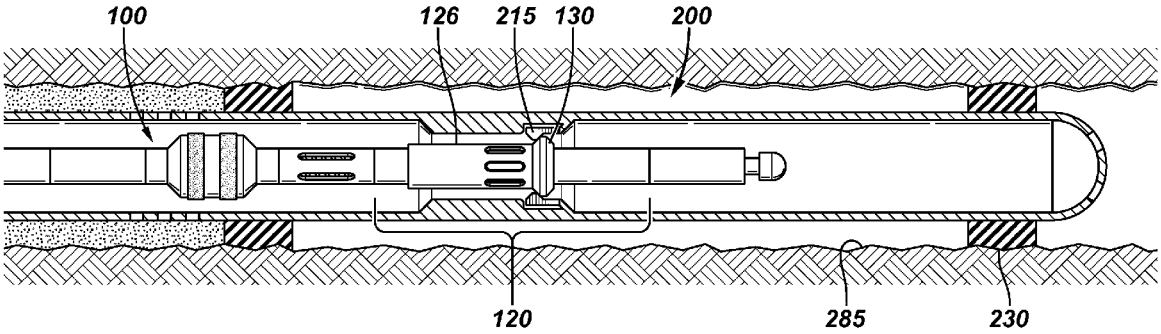
FIG. 5 depicts a cross sectional view of the completion system of FIG. 2 with the apparatus of FIG. 1 engaged with a collet, according to one or more embodiments described.

FIG. 5 depicts a cross sectional view of the completion system 200 with the running tool 100 engaged with the collet 215, according to one or more embodiments. When the running tool 100 is moved towards the surface, the collet 215 can engage the second tubular member 126 placing the circulation device 120 in the second configuration. The second tubular member 126 can engage the stopper 130 when the circulation device 120 is in the second configuration. When the circulation device 120 is in the second configuration, cleanup operations can be performed. For example, a reverse operation can be performed allowing excess gravel slurry to be removed from the running tool 100 and the completion assembly 205.

Figure 6:
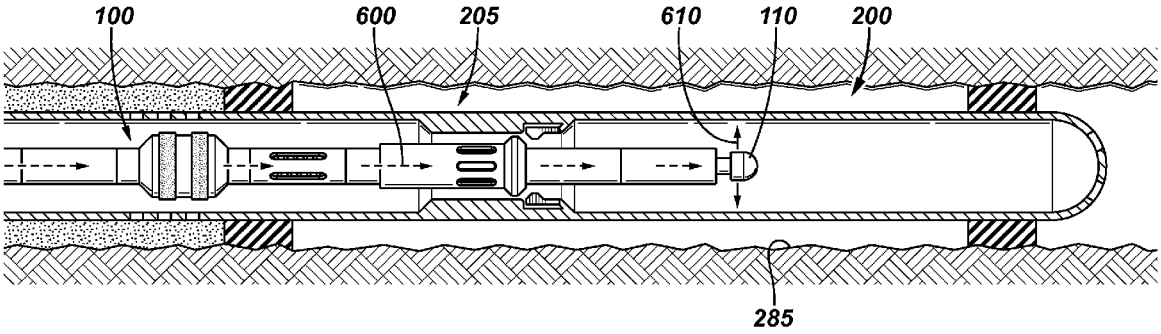
FIG. 6 depicts a cross sectional view of the completion system of FIG. 2 with the apparatus of FIG. 1 being removed therefrom, according to one or more embodiments described.

FIG. 6 depicts a cross sectional view of the completion assembly 205 with the running tool 100 being removed therefrom, according to one or more embodiments. As the running tool 100 is removed from the completion assembly 205, a treatment fluid, such as a breaking fluid, can be pumped into the running tool 100 and can flow within the running tool 100 to the rotatable nozzle 110 via flow path 600. As the treatment fluid exits rotatable nozzle 110, the treatment fluid can cause the rotatable nozzle 110 to rotate. Accordingly, when the fluid exits the rotatable nozzle 110, the fluid can be dispersed radially along flow path 610. As such, the rotation of the rotatable nozzle 110 allows even distribution of the treatment fluid about the wellbore 285. The even distribution of the treatment fluid about the wellbore 285 can ensure even removal of mudcake from the wellbore 285. After the applying treatment fluid to the wellbore 285, the running tool 100 can be fully removed from the completion assembly 205, and the completion assembly 205 can be used to produce hydrocarbons from the wellbore 285.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for performing a downhole operation, comprising:

an apparatus locatable at least partially within a completion assembly, the apparatus comprising:

a sealing mechanism having an inner bore formed therethrough;

a check valve adjacent the sealing mechanism;

a circulation device adjacent the check valve, the circulation device comprising:

a first tubular member having a radial hole formed therethrough; and a second tubular member disposed about at least a portion of the first tubular member, the second tubular member having a radial hole formed therethrough, wherein the second tubular member is adapted to longitudinally move about the first tubular member from a first position to a second position; and a rotatable nozzle adjacent the circulation device;

wherein the completion assembly comprises:

a first completion;

a second completion; and a connection device disposed therebetween; wherein the connection device comprises a collet configured to longitudinally move the second tubular member.

2. The system of claim 1, wherein the first completion is connected to a first end of the connection device and the second completion is connected to a second end of the connection device.

3. The system of claim 1, wherein the connection device further comprises a polished bore receptacle.

4. The system of claim 3, wherein the polished bore receptacle is configured to form a seal with the sealing member.

5. The system of claim 1, further comprising at least one packer disposed about the completion assembly.

6. The system of claim 1, wherein a selectively closable flow path from within the interior of the running tool to the exterior of the circulation device is formed when the second tubular member is in the first position.

7. The system of claim 1, wherein the second position of the second tubular member comprises a solid portion of the second tubular member aligned with the radial hole formed through the first tubular member.

8. A method for performing a downhole operation, comprising:

conveying a system into a wellbore, the system comprising:

an apparatus at least partially disposed within a completion assembly, the apparatus comprising:

a sealing mechanism having an inner bore formed therethrough;

a check valve adjacent the sealing mechanism;

a circulation device adjacent the check valve, the circulation device comprising:

a first tubular member having a radial hole formed therethrough; and a second tubular member disposed about at least a portion of the first tubular member, the second tubular member having a radial hole formed therethrough, wherein the second tubular member is adapted to longitudinally move about the first tubular member from a first position to a second position; and a rotatable nozzle adjacent the circulation device; and the completion assembly, comprising:

a first completion;

a second completion; and a connection device disposed therebetween; wherein the connection device comprises a collet configured to longitudinally move the second tubular member;

flowing fluid from within the apparatus through the circulation device into the wellbore with the circulation device in a first configuration;

locating the completion assembly within the wellbore adjacent a hydrocarbon bearing zone;

performing a downhole operation;

placing the circulation device in a second configuration; and flowing a treatment fluid through the rotatable nozzle, wherein the rotatable nozzle disperses the treatment fluid evenly about the wellbore.

9. The method of claim 8, wherein the first configuration of the circulation device comprises the radial hole of the first tubular member aligned with the radial hole of the second tubular member.

10. The method of claim 8, further comprising securing the completion assembly within the wellbore adjacent the hydrocarbon bearing zone.

11. The method of claim 8, wherein performing a downhole operation comprises pumping a gravel slurry between the completion assembly and a wall of the wellbore, and flowing at least a portion of the gravel slurry into the check valve.

12. The method of claim 8, wherein the apparatus is moved longitudinally as the treatment fluid is dispersed about the wellbore.

13. The method of claim 8, wherein the second tubular member engages a stopper when the circulation device is in the second configuration.

14. The method of claim 8, wherein the completion system is conveyed into the wellbore with the circulation device in the first configuration.

15. The method of claim 8, wherein the second position of the circulation device comprises the radial hole of the first tubular member aligned with a solid portion of the second tubular member.

16. The method of claim 8, wherein placing the circulation device in the second configuration comprises engaging at least a portion of the circulation device with at least a portion of the collet.

17. A method for performing a downhole operation, comprising:

conveying a system into a wellbore, the system comprising:

an apparatus at least partially disposed within a completion assembly, the apparatus comprising:

a sealing mechanism having an inner bore formed therethrough;

a check valve adjacent the sealing mechanism;

a circulation device adjacent the check valve, the circulation device comprising:

a first tubular member having a radial hole formed therethrough; and a second tubular member disposed about at least a portion of the first tubular member, the second tubular member having a radial hole formed therethrough, wherein the second tubular member is adapted to longitudinally move about the first tubular member from a first position to a second position; and a rotatable nozzle adjacent the circulation device; and the completion assembly, comprising:

a first completion;

a second completion; and a connection device disposed therebetween; wherein the connection device comprises a collet configured to longitudinally move the second tubular member.

18. The method of claim 17, wherein the first position of the circulation device comprises the radial hole of the first tubular member aligned with the radial hole of the second tubular member.

19. The method of claim 17, wherein the second position of the circulation device comprises the radial hole of the first tubular member aligned with a solid portion of the second tubular member.

20. The method of claim 17, further comprising:

pumping a gravel slurry between the completion assembly and a wall of the wellbore; and flowing at least a portion of the gravel slurry into the check valve.

* * * * *